US007389945B2

(12) United States Patent
Huang

(10) Patent No.: US 7,389,945 B2
(45) Date of Patent: Jun. 24, 2008

(54) SPRAY PAINT GUN STRUCTURE HAVING A COAXIAL CONTROL OF FLUID AND ATOMIZATION

(75) Inventor: Tiao-Hsiang Huang, Shin Chuang (TW)

(73) Assignee: Kuan Chang Co., Ltd., Taipei County (TW)

( * ) Notice: Subject to any disclaimer, the term of this patent is extended or adjusted under 35 U.S.C. 154(b) by 464 days.

(21) Appl. No.: 11/226,273

(22) Filed: Sep. 15, 2005

(65) Prior Publication Data

US 2007/0057092 A1 Mar. 15, 2007

(51) Int. Cl.
*B05B 1/28* (2006.01)
*B05B 1/30* (2006.01)

(52) U.S. Cl. ..... 239/300; 239/290; 239/296; 239/345; 239/582.1; 239/581.2

(58) Field of Classification Search ..... 239/290–301, 239/581.1, 582.1, DIG. 14, 345
See application file for complete search history.

(56) References Cited

U.S. PATENT DOCUMENTS 1,910,673 A * 5/1933 Bramsen ..... 239/300
1,982,055 A * 11/1934 Jenkins ..... 239/301
2,146,416 A * 2/1939 Bramsen et al. ..... 239/300
2,348,568 A * 5/1944 Pellar ..... 239/300
2,578,402 A * 12/1951 Dalrymple ..... 239/300
4,629,120 A * 12/1986 Diamond ..... 239/117
4,728,039 A * 3/1988 Johnson et al. ..... 239/296
4,917,300 A * 4/1990 Gloviak et al. ..... 239/290
4,993,642 A * 2/1991 Hufgard ..... 239/300
5,135,172 A * 8/1992 Toth ..... 239/297
5,152,460 A * 10/1992 Barty ..... 239/290
5,165,605 A * 11/1992 Morita et al. ..... 239/296
5,170,941 A * 12/1992 Morita et al. ..... 239/416.4
5,251,821 A * 10/1993 Toth ..... 239/297
5,322,221 A * 6/1994 Anderson ..... 239/291
5,409,162 A * 4/1995 Sickles ..... 239/3
6,098,902 A * 8/2000 Culbertson et al. ..... 239/290
6,533,187 B2 * 3/2003 May ..... 239/1
6,585,173 B2 * 7/2003 Schmon et al. ..... 239/526
6,626,382 B1 * 9/2003 Liu ..... 239/569
6,749,132 B2 * 6/2004 Pettit et al. ..... 239/296
2002/0166902 A1 * 11/2002 Pettit et al. ..... 239/296
2003/0025000 A1 * 2/2003 Schmon et al. ..... 239/296
2004/0046040 A1 * 3/2004 Micheli ..... 239/11
2004/0159720 A1 * 8/2004 Komornicki ..... 239/290
2005/0145718 A1 * 7/2005 Blette et al. ..... 239/290
2005/0145724 A1 * 7/2005 Blette et al. ..... 239/525

* cited by examiner

*Primary Examiner*—David J Isabella
*Assistant Examiner*—Daniel T Sharpe
(74) *Attorney, Agent, or Firm*—Rosenberg, Klein & Lee

(57) ABSTRACT

A spray paint gun structure having a coaxial control of fluid and atomization includes an atomization control air passage connected to a pressurized air passage in the rear section of a housing. An atomization control adjustment valve includes a sleeve, an atomization adjustment nut, a locking nut, and an elastic member. A rod extending from a fluid control adjustment valve penetrates through the sleeve. The middle section of the sleeve is provided with an external thread to engage with the atomization adjustment nut and the locking nut. The elastic member is accommodated in the rear section of the sleeve. The rear section of the sleeve is provided with an internal thread to relatively engage with a fluid adjustment nut. The atomization adjustment nut is provided with an external thread to engage with a thread relatively disposed at the rear section of the housing.

1 Claim, 3 Drawing Sheets

13
12
1
14,322
3
32
33
22
A
A
31
34
2
21
312
311,331
311,321
11

A-A

SPRAY PAINT GUN STRUCTURE HAVING A COAXIAL CONTROL OF FLUID AND ATOMIZATION

BACKGROUND OF THE INVENTION (a) Field of the Invention

The present invention relates to a spray paint gun structure having a coaxial control of fluid and atomization, and more particularly, to one that has an atomization control adjustment valve coaxially disposed at the rear section of the housing of the spray paint gun to allow the user to simultaneously adjust fluid and atomization at the rear section of the housing.

(b) Description of the Prior Art

The adjustment structure of a conventional spray paint gun is usually divided into fluid and atomization controls. The fluid control is disposed at the rear end of the spray paint gun and is done by rotating an adjustment screw to control the flow of the pressurized air, so that the amount of paint is to be delivered.

The atomization control is provided at a cap of a nozzle. By rotating the cap, the airflow of an atomized air passage located by a main air passage, i.e., the air passage to control the amount of paint, thus to change the extent of the atomization of the paint to be sprayed (i.e., the size of the atomized particles) and the spray pattern.

However, it takes both hands to adjust either control and it prevents the adjustment of both controls at the same time. Therefore, it becomes very inconvenient to use the spray paint gun because it usually needs several rounds of adjustment back and forth.

SUMMARY OF THE INVENTION

The primary purpose of the present invention is to provide a spray paint gun structure having a coaxial control of fluid and atomization to facilitate simultaneous adjustment of fluid amount to be delivered and atomization extent right at the rear section of the housing of the spray paint gun for a convenient operation control.

To achieve the purpose, the present invention includes a housing, a fluid control adjustment valve, an atomization control adjustment valve, a fluid control air passage, and an atomization control air passage. The housing contains a built-in pressurized air passage connecting through both the fluid control air passage and the atomization control air passage. The fluid control adjustment valve is disposed in the fluid control air passage in the front section of the housing of the spray paint gun. A rod extends from the fluid control adjustment valve to reach the rear section of the housing, and is linked to a fluid adjustment nut to move in the front section of the housing. The atomization control air passage is connected to the pressurized air passage in the rear section of the housing. The atomization control adjustment valve includes a sleeve, an atomization adjustment nut, a locking nut, and an elastic member. The sleeve permits the rod of the fluid control adjustment valve to penetrate through and the middle section of the sleeve is externally threaded. The elastic member is accommodated in the rear section of the sleeve, and the rear section of the sleeve is internally threaded to relatively engage with the fluid adjustment nut. Both the atomization adjustment nut and the locking nut are hollow and internally threaded to relatively engage with the middle section of the sleeve. The atomization adjustment nut is externally threaded, and the rear section of the housing is relatively disposed with a thread for the atomization adjustment nut to be fastened to the rear section of the housing.

Accordingly, the present invention provides the following advantages:

1. Convenient operation since the user is allowed to adjust the fluid amount to be delivered and the extent of atomization at the same time at the rear section of the housing of the spray paint gun; and 2. Easy adjustment since the user will only turn around the nut at the rear section of the spray paint gun.

DETAILED DESCRIPTION OF THE PREFERRED EMBODIMENTS

Figure 1:
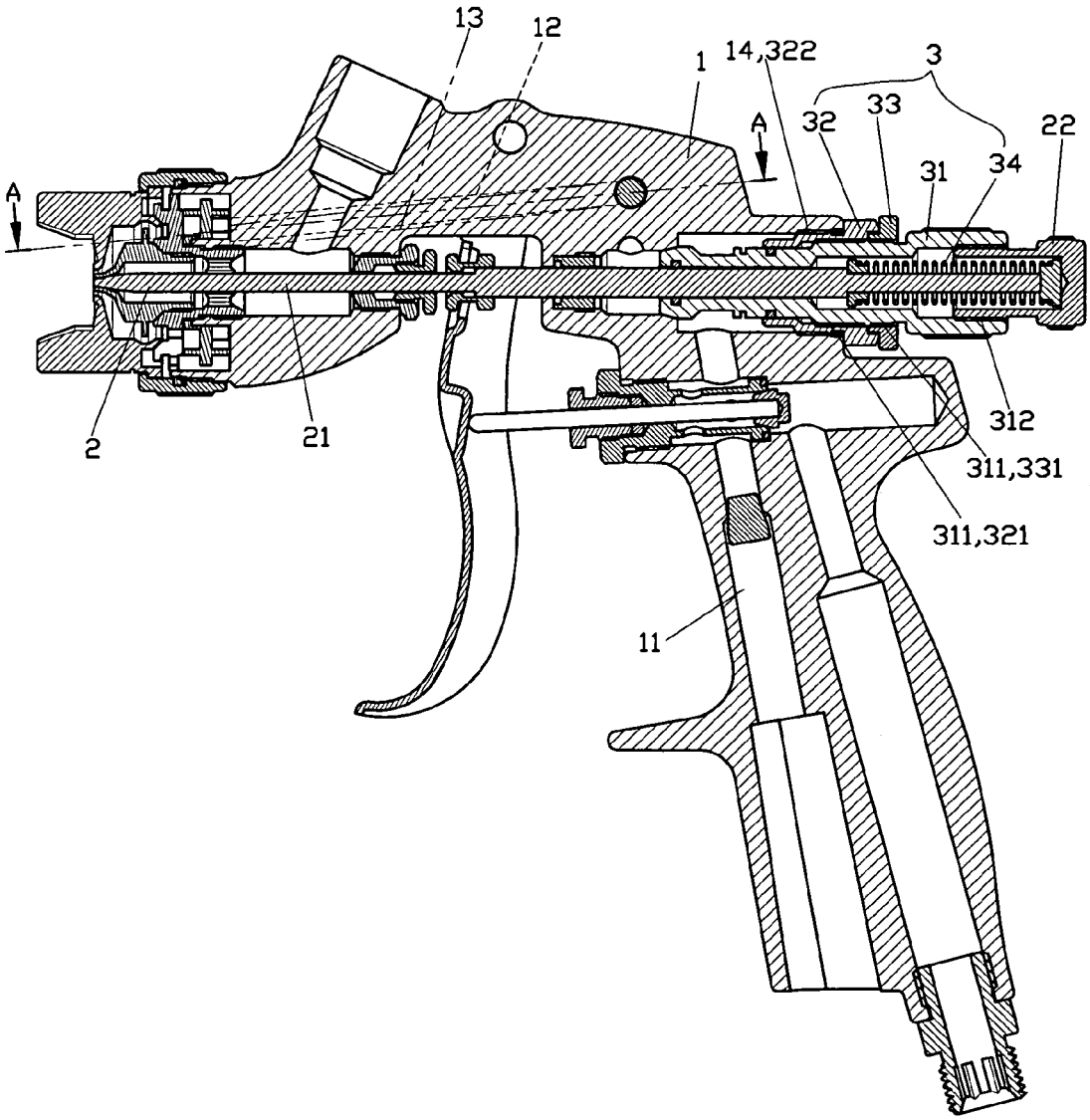
FIG. 1 is a side sectional view of a preferred embodiment of the present invention.
Figure 2:
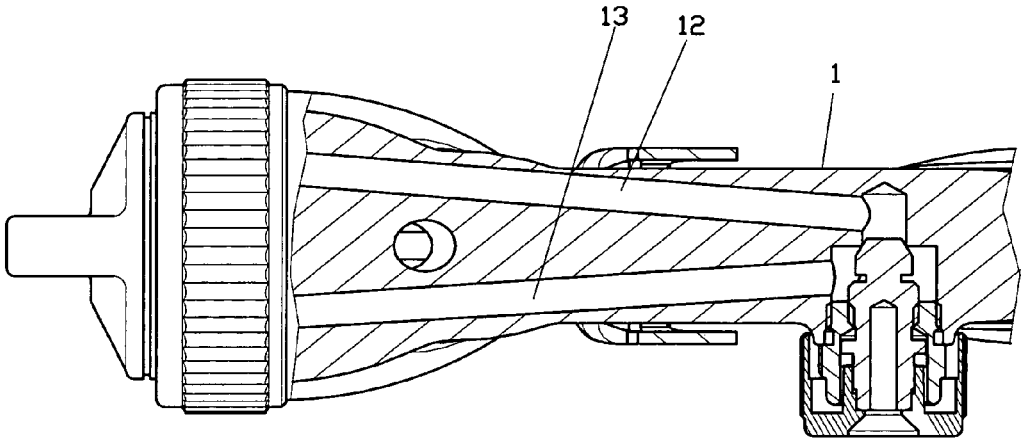
FIG. 2 is top sectional view showing air passages of the preferred embodiment of the present invention.

Referring to FIGS. 1 and 2, a preferred embodiment of the present invention includes a housing (1) of a spray paint gun, a fluid control adjustment valve (2), an atomization control adjustment valve (3), a fluid control air passage (12), and an atomization control air passage (13).

The housing (1) contains a built-in pressurized air passage (11) connecting through both the fluid control air passage (12) and the atomization control air passage (13). It is to be noted here that the valve not numbered in FIG. 2 is used for On/Off operation of the air passages, not for adjustment purpose.

The fluid control adjustment valve (2) is disposed in the fluid control air passage (12) in the front section of the housing (1) of the spray paint gun. A rod (21) extends from the fluid control adjustment valve (2) to reach the rear section of the housing (1) and is linked to a fluid adjustment nut (22) disposed at the rear section of the housing (1) to move in the front section of the housing (1).

The atomization control air passage (13) is connected to the pressurized air passage (11) in the rear section of the housing (1). The atomization control adjustment valve (3) includes a sleeve (31), an atomization adjustment nut (32), a locking nut (33), and an elastic member (34). The sleeve (31) permits the rod (21) of the fluid control adjustment valve (2) to penetrate through. The middle section of the sleeve (31) is provided with an external thread (311). The elastic member (34) is accommodated in the rear section of the sleeve (31). The rear section of the sleeve (31) is provided with an internal thread (312) to relatively engage with the fluid adjustment nut (22). Both the atomization adjustment nut (32) and the locking nut (33) are hollow and respectively provided with an internal thread (321, 331) to relatively engage with the external thread (311) provided on the middle section of the sleeve (31). The atomization adjustment nut (32) is provided with an external thread (322) to engage with a thread (14) relatively disposed at the rear section of the housing (1).

Figure 3:
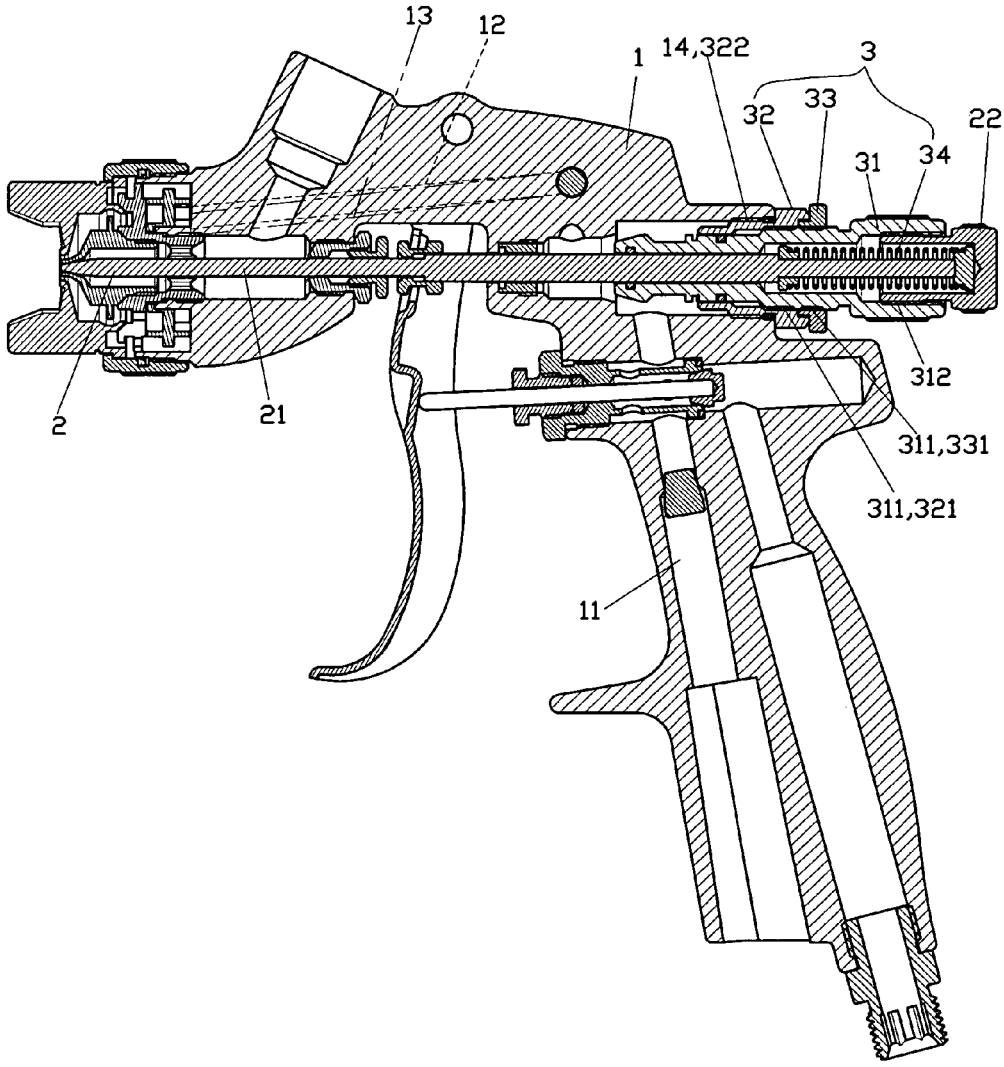
FIG. 3 is a schematic view of the preferred embodiment of the present invention.

In practice as illustrated in FIG. 3, the user simply turns around the fluid adjustment nut (22) at the rear section of the housing (1). Meanwhile, the user simply loosens up the locking nut (33), turns around the atomization adjustment nut (32), and finally tightens up the locking nut (33) against the atomization adjustment nut (32) to complete the adjustment of atomization. Accordingly, the spray paint gun is easy to operate because all adjustment operation is done at the rear section of the housing (1) of the spray paint gun.

I claim:

1. A spray paint gun structure having a coaxial control of fluid and atomization comprising a housing, a fluid control adjustment valve, an atomization control adjustment valve, a fluid control air passage, and an atomization control air passage; the housing containing a built-in pressurized air passage connecting through both the fluid control air passage and the atomization control air passage; the fluid control adjustment valve being disposed in the fluid control air passage in a front section of the housing, the fluid control adjustment valve extending a rod to a rear section of the housing, and the rod being linked to a fluid adjustment nut to move in the front section of the housing; and characterized by:

the atomization control air passage being connected to the pressurized air passage in the rear section of the housing, the atomization control adjustment valve including a sleeve, an atomization adjustment nut, a locking nut, and an elastic member; the sleeve being hollow for the rod of the fluid control adjustment valve to penetrate through; a middle section of the sleeve being externally threaded, the elastic member being accommodated in a rear section of the sleeve, the rear section of the sleeve being internally threaded to relatively engage with the fluid adjustment nut; both the atomization adjustment nut and the locking nut being hollow and internally threaded to relatively engage with the middle section of the sleeve; the atomization adjustment nut being provided with an external thread to engage with a thread relatively disposed at the rear section of the housing.

* * * * *